United States Patent [19]

Timmerman

[11] Patent Number: 4,850,741

[45] Date of Patent: Jul. 25, 1989

[54] BOAT HOIST

[76] Inventor: William D. L. Timmerman, 3235 Alco Dr., Pontiac, Mich. 48055

[21] Appl. No.: 127,466

[22] Filed: Dec. 2, 1987

[51] Int. Cl.[4] ..... B63C 3/06

[52] U.S. Cl. ..... 405/3; 405/7

[58] Field of Search ..... 405/1, 3, 7; 114/44, 114/45

[56] References Cited

U.S. PATENT DOCUMENTS

| | | | |
|---|---|---|---|
| 3,021,965 | 2/1962 | Harvey | 405/3 X |
| 3,139,732 | 7/1964 | Thompson | 405/3 |
| 4,037,421 | 7/1977 | Whitley | 405/3 |

*Primary Examiner*—David H. Corbin

*Attorney, Agent, or Firm*—John R. Benefiel

[57] ABSTRACT

A boat hoist for raising and storing boats mounted on legs resting on the bottom and a pair of parallel angled swing leg assemblies raising a boat support rail member mounted on the upper ends thereof, with a fluid pressure actuator powering elevation of a swing leg assembly to raise a boat on cradle supports mounted on the rail member. A bow post carrying cradling rollers is pivoted to the forward end of the rail member, spring biased into an upright position to facilitate centering of the boat during the approach to the hoist. Adjustable height inwardly inclined feet support the support frame on the bottom surface.

6 Claims, 2 Drawing Sheets

Fig-1
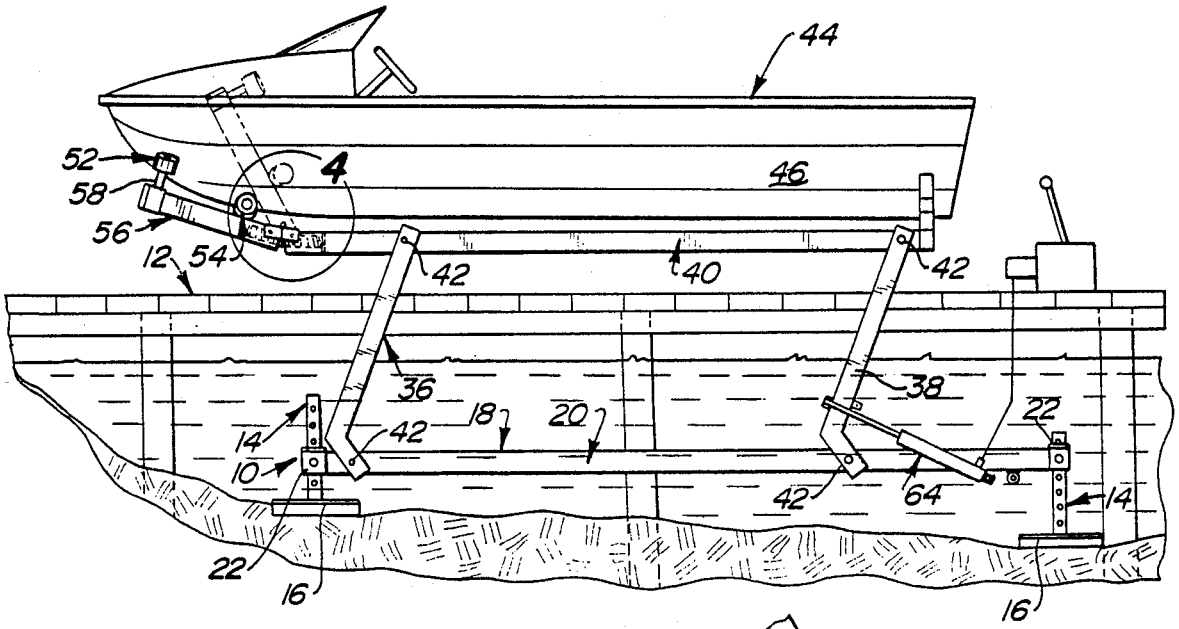
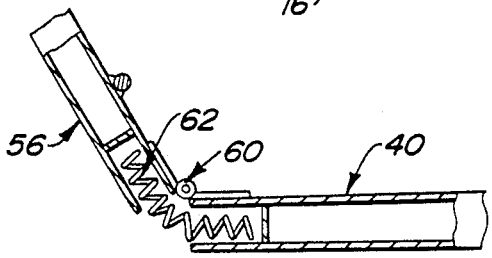
Fig-4
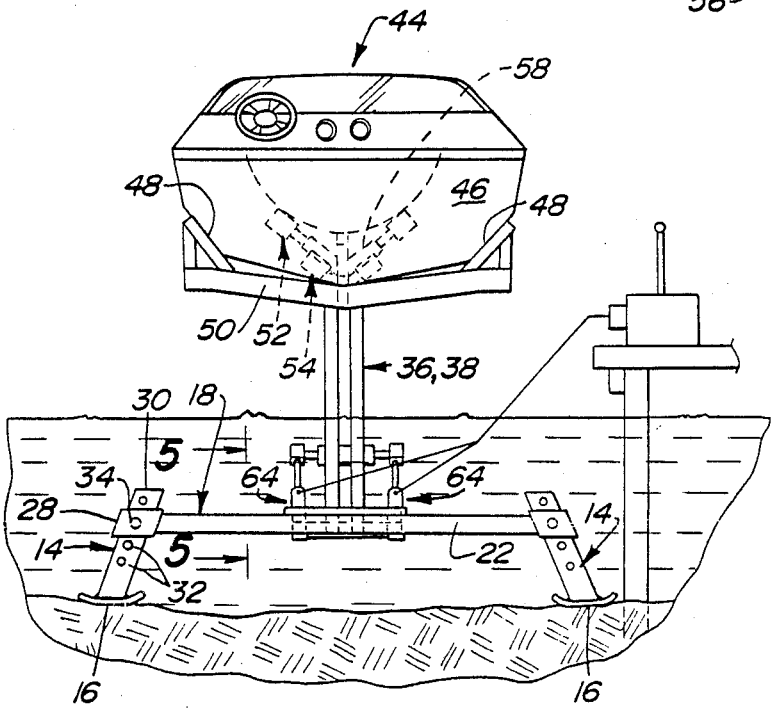
Fig-2

BOAT HOIST

FIELD OF THE INVENTION

This invention concerns hoisting devices and more particularly a device adapted to hoist boats disposed afloat in a body of water to a moored position above the water surface.

BACKGROUND OF THE INVENTION

It has long been considered desirable to moor smaller boats out of the water for various reasons, such as to prevent algae growth on the hull and to avoid the hazards of wave action on a boat moored at dockside.

There has heretofore been provided various hoisting structures for this purpose adapted to be placed on the bottom of a lake or other body of water, usually alongside a dock, and which are either manually operated or powered to winch a boat floated over the structure up out of the water.

For the most part, these devices have taken the form of complex and bulky rectangular frames which are expensive and do not have a trim appearance.

In U.S. Pat. No. 2,505,832 to Lange, there is disclosed a trimmer appearing hoist utilizing a set of parallel swing legs, with a power cylinder mounted horizontally to act on one of the legs. This mounting produces disadvantageous leveraging in the raised position. Further, as a result of the poor leveraging, the lifting legs are moved to a dead center condition when the boat is in the moored, hoisted position. The dead center condition may require manual shoving of the boat to initiate lowering, and the boat is less stably supported in the hoisted position so that wind and wave action may set up noisy vibrations.

Finally, the Lange structure is totally submerged when in place, making maneuvering of a boat to the proper position for hoisting difficult where viewing of the hoist is difficult because of water or lighting conditions.

Accordingly, it is an object of the present invention to provide an improved swing leg type boat hoist, in which powered movement of the swing legs is achieved with an advantageous leveraging of the power cylinders, and stable positioning of the boat in the hoisted position is accomplished allowing lowering of the boat without having to overcome a dead center condition.

Another object is to provide a submerged boat hoist in which maneuvering of the boat into proper position over the hoist to be raised is facilitated.

SUMMARY OF THE INVENTION

These and other objects of the present invention are accomplished by a boat hoist including a pair of swing leg assemblies pivotally mounted at this lower end to a central support frame member and at the upper ends to a boat support rail so as to form a parallel linkage. The swing leg assemblies according to the present invention are angled rearwardly to allow lowering very close to the central frame member, and to allow an advantageous mechanical advantage of one or more power cylinders used to elevate the swing leg assemblies to raise a boat supported on cradle elements carried by the boat support rail. The one or more power cylinders are pivoted at one end to the central frame member and at the other to the upper angled section of a swing leg assembly. At full extension of the one or more power cylinders, the swing leg assemblies are inclined rearwardly to create a downward bias by the weight of the supported boat and elevated hoist portions. In this position the one or more power cylinders preferably lie normal to the upper section of the attached swing leg assembly to provide maximum clearance while allowing effective use of a power cylinder actuation.

A spring biased bow post having hull engaging cradle elements is mounted to the forward end of the boat support rail member so as to be upwardly oriented extending above the water surface, providing a sighting target as an aid in maneuvering a boat over the cradle members. Upon advance of the boat, the bow post cradle elements are engaged and the bow post is lowered by the weight of the boat, allowing the bow post to assume a portion of the weight of the boat.

DESCRIPTION OF THE DRAWINGS

FIG. 1 is a side elevational view of a boat hoist according to the present invention installed on the bottom of a body of water with a boat hoisted to the moored position above the water surface and alongside a dock.

FIG. 2 is an end view of the scene of FIG. 1.

FIG. 4 is a fragmentary enlarged, partially sectional view of the bow post portion of the boat hoist shown in FIGS. 1–3.

DETAILED DESCRIPTION

Figure 3:
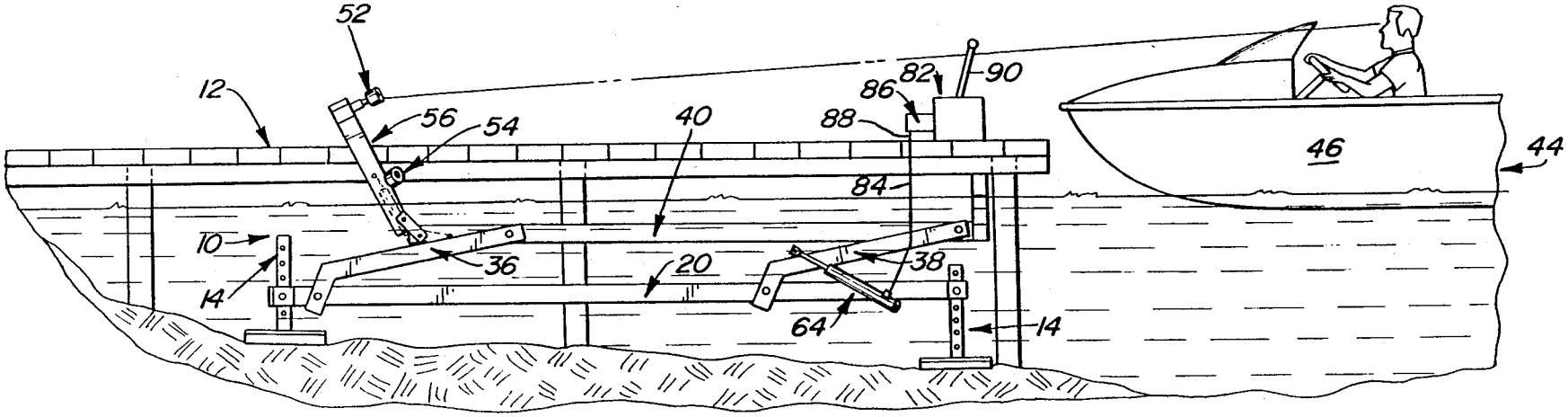
FIG. 3 is a side elevational view of the boat hoist shown in FIG. 1 in the lowered condition and depicting the approach of a boat to be moored thereon.

In the following description, certain specific terminology will be employed for the sake of clarity, and a particular embodiment illustated for the sake of clarity, but it is to be understood that the same is not intended to be limiting, as the invention is capable of taking many forms and variations within the scope of the appended claims.

Referring to FIG. 1, the boat hoist 10 according to the present invention is intended to be installed submerged on the bottom of a lake or other body of water, alongside a dock 12, as shown.

The boat hoist 10 is supported by a plurality of vertically adjustable upright feet 14, having foot pads 16 resting directly on the lake bottom.

The feet 12 are mounted on a support frame 18 formed of a planar array of frame members, including an elongated central frame member 20, extending longitudinally, with a pair attached cross rigger frame members 22 extending transversely from the fore and aft ends of the central frame member 20.

The frame members 20, 22 and feet 14 are preferably all formed of rectangular steel tubing, coated with a marine grade of paint or other suitable waterproof surface treatment.

Figure 5:
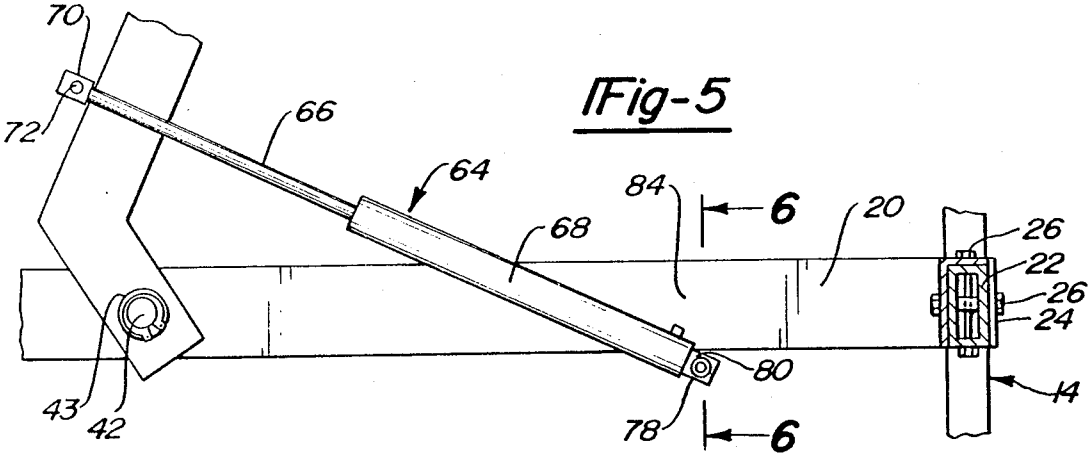
FIG. 5 is an enlarged, fragmentary, side elevational view of the installation of a power cylinder and connection of support frame members utilized in the boat hoist shown in FIGS. 1–3.

In order to allow ready disassembly, the connection between the outrigger frame members 22 may be attached by U-flanges (FIG. 5) welded to the central frame member, nesting over the outrigger frame members 22 and attached with nut and bolt sets 26 as shown.

The feet 14 are each independently adjustable as by being received in collars 28 welded to the ends of the cross rigger members 22 with a hole 30 able to be brought into successive alignment with a series of holes 32 in the foot 14, a pin 34 securing the same in any adjusted position. Thus the support frame 20 can and should be leveled on an uneven lake bottom surface as shown in FIG. 1.

The boat hoist 10 further includes a pair of fore-and-aft spaced swing leg assemblies 36 and 38 each pivotally mounted at their lower ends to the central frame member 20 and at their upper ends to an elongated boat support rail 40 aligned above the central frame member 20.

Each swing leg assembly 36, 38 may be comprised of aligned pairs of steel rectangular tubing sections (FIGS. 2, 6) straddling both the central frame member 20 and the boat support rail 40, with cross pins 42 establishing a pivotal connection and snap rings 43 (FIG. 5) or other suitable retainers employed to keep the cross pins 42 in position.

The fore-and-aft swing leg assemblies 36 and 38 are connected in parallel to form a parallel linkage with the boat support rail 40, swingable from a down position, shown in FIG. 3, extending in generally a horizontal direction roughly parallel to the plane of the support frame 20; to an upright raised position as shown in FIG. 1. In so moving, a boat 44 is floated over the hoist 10 and can be raised above the surface of the water.

The hull 46 of the boat 44 is engaged by a series of cradle elements carried by the boat support rail, cradle elements including transversely extending inclined rails 48 (FIG. 2) mounted on a cross rail 50, itself vee-shaped to mate with the hull 46.

The cradle elements also comprise rubber roller pairs 52, 54 mounted to a bow post 56 pivotally mounted to the forward end of boat support rail 40, by means of transverse, inclined roller shafts 58 affixed to the bow post 56, also forming a shallow vee to receive the lower bow portions of the boat hull 46.

The bow post 56, as noted, is pivotally mounted with a hinge joint 50, and is spring biased to an upright position by a coil spring 62. The bow post 56 assumes an upright position when a boat 44 is not in position, as shown in FIG. 1 in phantom, and in FIG. 3. In the upright position, the bow post 56 extends well above the water surface, to provide a sighting target to a boatman as indicated in FIG. 3, facilitating maneuvering the boat over the hoist 10 to a position centered on the cradle elements.

As the boat 44 moves forward, the bow post 56 collapses as the roller pairs 52, 54 are pushed down by the weight of the boat 44.

The boat post 56 ultimately abuts the forward end of the boat support rail 40 in a position slightly inclined above the horizontal as shown in FIG. 1, with the weight of the hull partially borne by the roller pairs 52, 54, and transmitted into the boat support rail 40.

According to the concept of the present invention, the swing leg assemblies 36 and 38 are each angled rearwardly at a point intermediate their length, in order to allow effective powered elevation by a pair of fluid power cylinders 64 associated with the rear swing leg assembly 38.

Figure 6:
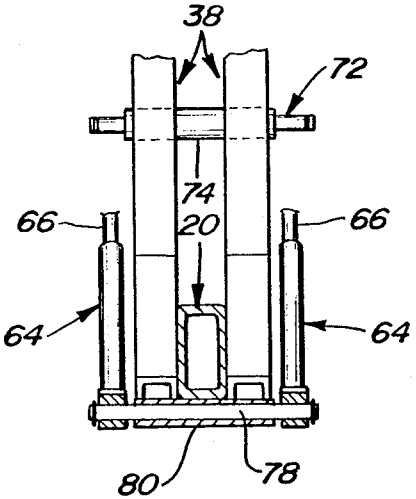
FIG. 6 is a view of the section 6—6 taken in FIG. 5.

The fluid power cylinders 64 each include an operating rod 66 extending from the cylinder body 68 having a clevis 70 received over a pivot pin 72 carried within a bushing 74 welded to the swing leg assembly 38 (FIG. 6).

Each cylinder body 68 also has a clevis 76 attached to the opposite end, each of which is received over a lower pivot pin 78 carried within a bushing 80 welded to the central frame member 20.

The fluid power cylinders 64 are thus each pivoted at either end to the central frame member 20 and the swing arm assembly 38 at the section above the point of angling thereof.

The power cylinders 64 are selectively able to be pressurized from a hydraulic pressure source 82 supplying pressure via line 84 to cause extension of the cylinders 64 when the boat 44 is to be hoisted. The pressure source 82 may be any conventional, commercially available pump reservoir, and valving package suitable for the application, and may be battery operated or by other source of electrical power.

In the boat lauching, a valve, depicted schematically, opens to allow bypass of hydraulic fluid so that the cylinders 64 may collapse under the weight of the boat and hoist members. A suitable flow restrictor 88, shown schematically can be included to control the flow and rate of descent.

A manual control handle 90 is provided to enable convenient control for hoisting or launching.

In the fully extended condition of the power cylinders 64 as shown in FIGS. 1 and 6 the power cylinders 64 lie substantially normally to the upper section of the swing arm assembly 38, and the swing arm assembly 38 is angled to the rear.

These relationships produce the results, that the swing arm assemblies 36, 38 are loaded in the hoisted position by a component of the boat weight, stabilizing the assembly against wind and wave action, with close to peak mechanical advantage of the cylinders 64.

In the condition, a hydraulic lock is maintained in the cylinder 64 and lines 84 to resist the tendency for lowereing to occur as will be understood by those skilled in this art.

Upon opening of valve 86, the boat 44 immediately begins lowering under the weight of the boat 44 without any need to overcome a dead center condition.

The angled swing arm assemblies also provide an aesthetically pleasing appearance.

Accordingly, the above objects are achieved by the described structure, which also is easily disassembled for an easy one or two man installation.

I claim:

1. A boat hoist comprising:

a support frame formed by a planar array of frame members, and including a longitudinally extending central frame member assembly having a forward and rear end;

a plurality of generally upright support legs mounted to said support frame members to enable support of said support frame on a bottom surface;

a pair of elongated swing leg assemblies, pivotally mounted at the lower end to said central frame member assembly at fore-and-aft spaced locations, each of said elongated swing leg assemblies including one or more swing legs, each having a lower and upper portion joined together to extend at an angle to each other so that said swing leg assemblies are angled rearwardly at a point intermediate the length thereof;

an elongated boat support rail assembly pivotally attached to the upper end of each of said swing leg assemblies, said swing leg assemblies, said central frame member assembly, and said boat support rail member assembly forming a parallel linkage enabling raising of said boat support rail member above said support frame while remaining parallel thereto by swinging motion of said swing leg assemblies about said pivotal mounting of said lower ends thereof;

boat cradle elements carried to said boat support rail member assembly having portions thereof extending tranversely thereto and configured in a general vee shape to engage a boat hull;

at least one fluid pressure actuator mounted to said support frame, having an elongated actuator member extending from said actuator, said actuator member pivotally connected to the upper portion of a swing leg of one of said swing arm assemblies at a point substantially above said point whereat said upper and lower portions are joined at an angle, said actuator member movable from a retracted position wherein said swing arm assemblies are in a lowered position extending generally in the same direction as the plane of said support frame, to a fully extended position in which said swing arm assemblies are raised above said support frame, said swing arm assemblies upper portions angled towards said fluid pressure actuator; said actuator member extending substantially normally to said upper portion in the fully raised position, said upper portion angled downwardly in the raised position, but extending at a blunt angle to said lower portion in the lowered position, whereby a boat may be advanced over said boat cradle elements with said boat hoist submerged and said swing leg assemblies lowered, and subsequently hoisted up by actuation of said fluid pressure actuator and raising of said swing arm assemblies to be supported above the water on said boat cradle elements, any dead center condition in the raised and lowered position avoided by said angled swing arm assemblies.

2. The boat hoist according to claim 1 wherein said cradle support members include a bow post pivotally mounted at the forward end of said boat support rail member assembly, and bias means resiliently urging said bow post to an upright position to thereby provide a sighting feature to facilitate advancing the boat over said boat cradle elements, said bow post having attached cradling elements engageable with a boat hull, whereby said bow member may be moved to a generally horizontal position upon advance of a boat thereover.

3. The boat hoist according to claim 1 wherein said support frame comprises outrigger members attached to said central frame member assembly to extend transversely thereto, and wherein said support legs are inclined towards said central frame member assembly.

4. The boat hoist according to claim 1 wherein each of said swing leg assemblies comprises a pair of aligned swing leg members each having upper and lower portions joined to extend at an angle to each other straddling both said central frame member assembly and said boat support rail assembly.

5. The boat hoist according to claim 3 wherein said outrigger frame members are bolted to said central frame member assembly.

6. The boat hoist according to claim 4 including a side by side pair of fluid pressure actuators each having an actuator member pivotally connected to the upper portion of a respective one of said swing leg members in each of said swing leg assemblies.

* * * * *